United States Patent [19]

Bontrager

[11] 4,030,705

[45] June 21, 1977

[54] VEHICLE SUPPORTED MOTOR LIFT

[76] Inventor: Jacob Bontrager, 809 3rd Ave. NE., Jamestown, N. Dak. 58401

[22] Filed: Jan. 19, 1976

[21] Appl. No.: 649,917

[52] U.S. Cl. ..... 254/139.1; 180/64 R

[51] Int. Cl.[2] ..... B66C 23/60

[58] Field of Search ..... 254/139.1, 4 R, 93 R, 254/2; 248/3, 4, 5; 180/64 R, 54 R, 69 R; 214/396, 394, 450

[56] References Cited

UNITED STATES PATENTS

| | | | |
|---|---|---|---|
| 1,242,712 | 10/1917 | Mayer et al. | 180/54 R |
| 2,433,822 | 12/1947 | Bartholomew | 214/394 |
| 2,772,010 | 11/1956 | Buehring | 254/139.1 |
| 3,001,763 | 9/1961 | Pilot | 254/139.1 |
| 3,652,057 | 3/1972 | Brown | 254/139.1 |
| 3,794,296 | 2/1974 | Hasstedt | 254/139.1 |
| 3,797,672 | 3/1974 | Vermette | 254/139.1 |
| 3,831,791 | 8/1974 | Gonzales | 254/4 R |

*Primary Examiner*—Albert J. Makay
*Assistant Examiner*—Kenneth Noland
*Attorney, Agent, or Firm*—Marmaduke A. Hobbs

[57] ABSTRACT

A vehicle supported motor lift in which a generally horizontal beam is supported at each end by vertically adjustable legs, and a power operated lift mechanism is mounted on the beam and operates a vertically movable member extending downwardly from the beam for connection with the vehicle motor. A hydraulic cylinder is preferably used to operate the lift mechanism and is normally controlled by a portable hydraulic pump which may be manually operated. The hydraulic cylinder may be mounted parallel and in close proximity to the horizontal beam and a cable with an attachment means on the end thereof is connected to the hydraulic cylinder and extends downwardly from the beam. As an alternative, a vertically movable frame operated by the hydraulic cylinder may be used. The legs are disposed adjacent the two ends of the beam, and are relatively short to permit the motor lift to be readily and conveniently mounted on the vehicle above the engine or in the cab of van type vehicles.

12 Claims, 10 Drawing Figures

Fig. 1
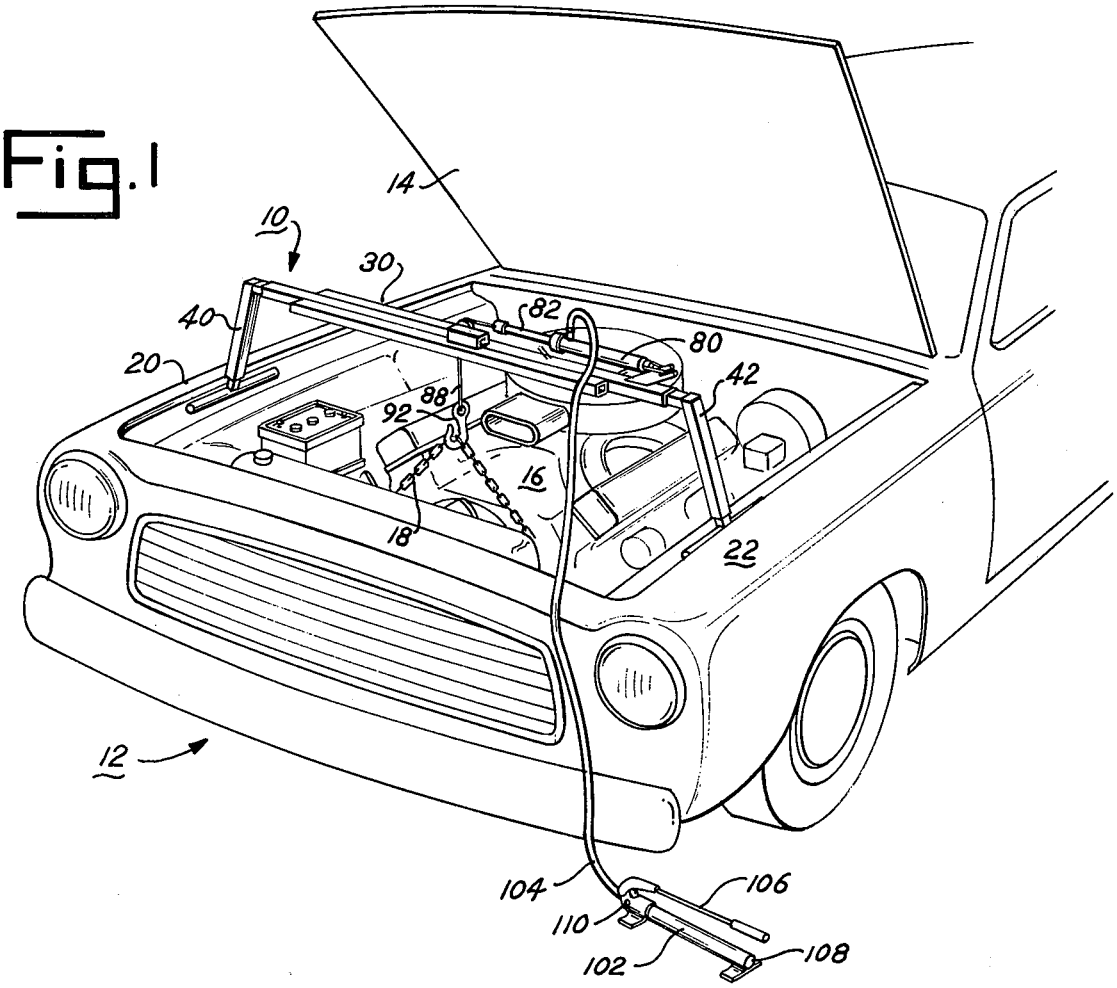
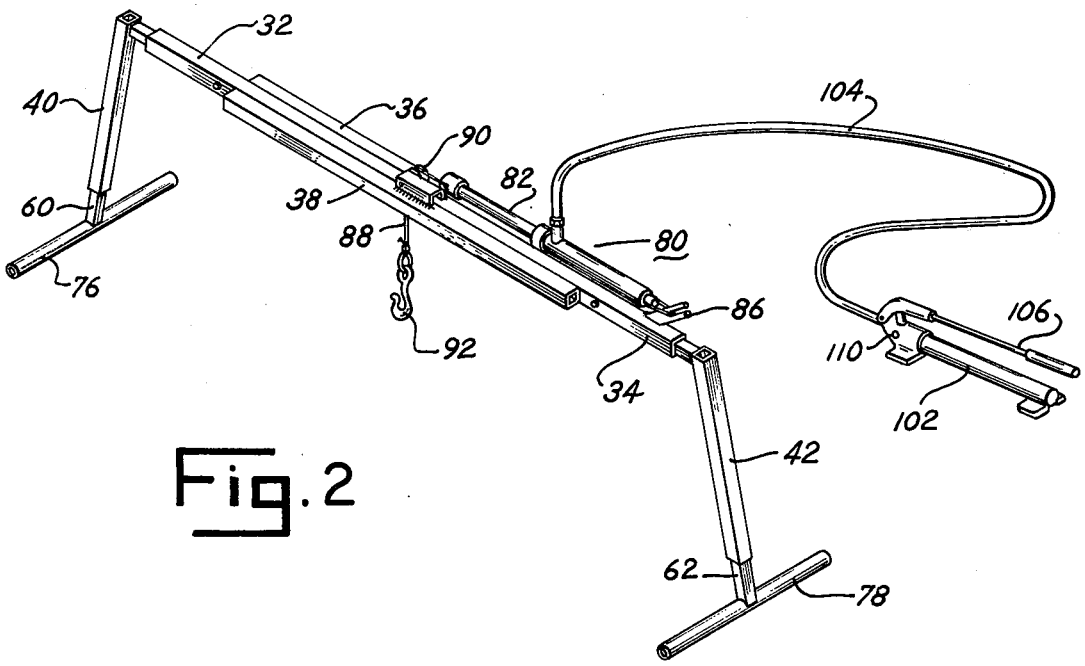
Fig. 2

VEHICLE SUPPORTED MOTOR LIFT

In servicing and repairing automobile and truck engines and chassis, it is often necessary or desirable to lift the engine a few inches to permit access to the part or location where the work is to be performed. For example, in replacing the motor mounts, the engine must be raised to give sufficient clearance between the bottom of the engine and the vehicle frame to release and replace the worn mounts. Lifting the enging is also necessary in some vehicles in removing the oil pan. In the past, overhead hoists supported by a beam above the vehicle, or a jack placed beneath the vehicle have been used to raise the engine sufficiently to perform the service or repairs. These prior practices have been unsatisfactory, inconvenient and/or hazardous, and in many instances could not be used because of interference encountered from other vehicle parts such as the hood, cab or frame members. It is therefore one of the principal objects of the present invention to provide a lift device for raising the engine a few inches to permit service and repair operations to be conveniently performed, which does not depend upon nor require a support external of the vehicle, for raising the engine when the service or repairs are to be performed.

Another object of the invention is to provide a vehicle engine motor lift which can readily be adjusted to handle engines of the under hood type in automobiles or those in or under the cab of trucks and vans, and which is easily mounted and operated on or in the vehicle in position where the engine can be most effectively lifted to provide the desired working clearance for the service or repair work being performed.

Still another object of the invention is to provide a lift mechanism for raising vehicle engines, which can be supported on the vehicle frame, body or fender, or a combination of these vehicle parts, when lifting the engine to provide the working clearance, and which can be operated and controlled at a location remote from the engine or at the location where the servicing and repairing operations are being performed.

A further object is to provide a vehicle motor lift device of the aforesaid type which is convenient and safe to use, and which is simple in construction and operation and can be easily stored when not in use, and readily carried or otherwise moved into operating position on the vehicle on which the service or repairs are to be made.

Additional objects and advantages of the present invention will become apparent from the following description and accompanying drawings, wherein:

FIG. 1 is a perspective view of the front end of a conventional automobile and the present vehicle supported lift mounted thereon, illustrating the manner in which the motor lift is used;

FIG. 2 is a perspective view of the present vehicle supported motor lift, showing it removed from the vehicle;

Figure 7:
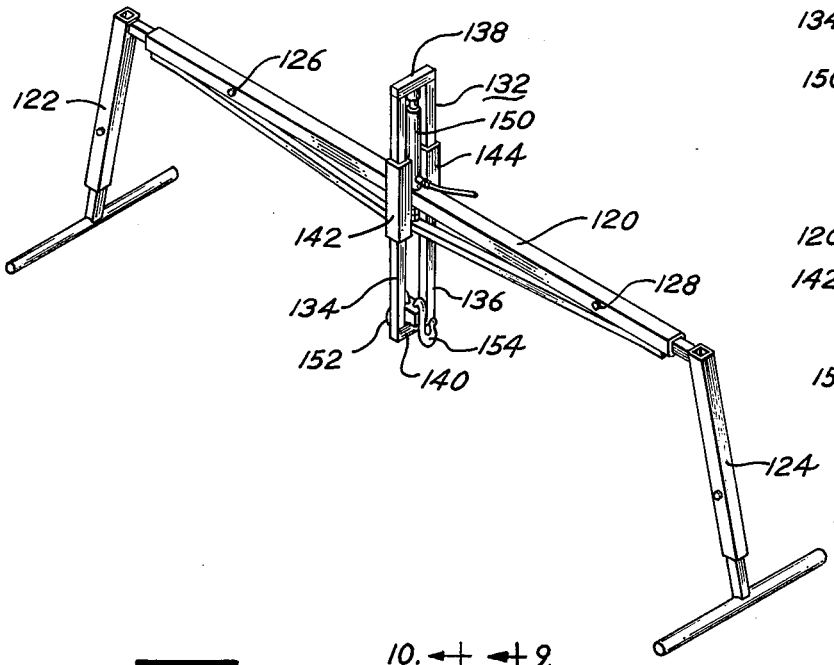
FIG. 7 is perspective view of a modified form of the present vehicle supported motor lift.
Figure 10:
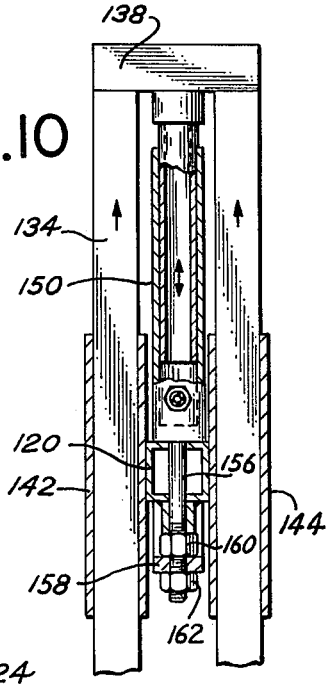
Figure 8:
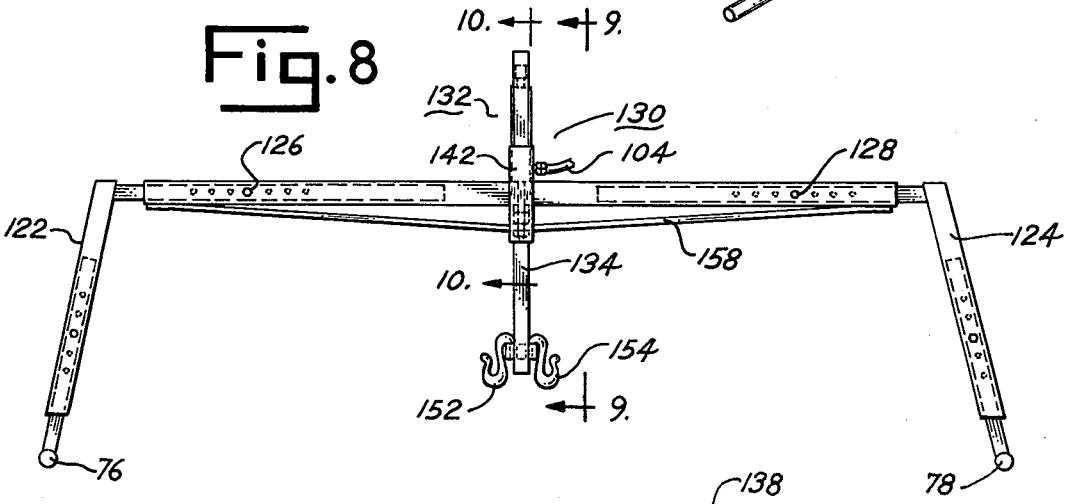
FIG. 8 is a side elevational view of the motor lift shown in FIG. 7.
Figure 9:
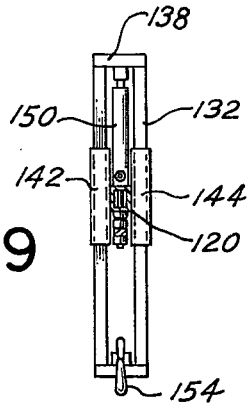

FIG. 9 is a partial cross sectional and elevational view of the motor lift shown in FIGS. 7 through 10, the section being taken on line 9 — 9 of FIG. 8; and FIG. 10 is an enlarged fragmentary cross sectional view taken on line 10 — 13 of FIG. 8.

Referring more specifically to the drawings and to FIGS. 1 through 6 in particular, numeral 10 indicates generally the present vehicle supported motor lift, and 12 an automobile on which the motor lift is mounted. Hood 14 of the automobile is shown raised and the present lift is shown in place for raising the motor 16 using a chain 18 placed around the motor and connected to the motor lift. While, the motor lift is shown mounted on the shields of the right and left front fenders 20 and 22, various other ways in which the lift can be used will be explained in further detail herein in connection with the two embodiments disclosed.

Motor lift 10 includes a main beam 30 constructed of two tubular end members 32 and 34 rigidly connected to one another by side members 36 and 38, the two side members preferably being welded to the two end members to form a rigid structure of sufficient strength to be capable of lifting all standard automobile engines. The two end and two side members are of metal and are of square tubular construction. The ends of beam 30 are supported by posts 40 and 42 having vertically disposed members 44 and 46 of square tubular construction and horizontally disposed members 48 and 50 connected to members 44 and 46, respectively. Members 48 and 50 are of metal and are secured by welding to members 44 and 46 to form rigid structures. Members 48 and 50 are telescopically disposed in members 32 and 34 and are held in various adjusted positions by pins or bolts 52 and 54 extending through holes in the side walls of members 32 and 34 and through one of a series of holes 56 and 58 in the two members 48 and 50.

Posts 40 and 42 are provided with legs 60 and 62 having vertical members 64 and 66 extending into tubular members 44 and 46 and being held in various adjusted positions by pins or bolts 68 and 70 extending through holes in members 44 and 46 and through one of a series of holes 72 and 74 in legs 60 and 62. Legs 60 and 62 are provided with feed 76 and 78 joined rigidly to the vertical portion of the legs and forming a firm support for the motor lift when it is placed on a suitable supporting structure, such as the fender portions illustrated in FIG. 1.

In the embodiment of the invention illustrated in FIGS. 1 through 6, the motor lift mechanism consists of a hydraulic cylinder 80 having a piston rod 82 and piston 84 therein. One end of the cylinder is connected to a rigid support member 86 and the free end of the piston rod 82 is connected to a cable 88 which extends over a pulley 90 and is provided with a hook 92 or other suitable connecting means on the lower end thereof for lifting the motor. The cable is firmly connected to the outer end of piston rod 82 by a screw or other securing means 94, and the pulley is rotatably supported by a block 96 and shaft 98 rigidly connected to block 96. The two end members 32 and 34 of beam 30 are spaced from one another at the center, thus providing an opening 100 through which the cable extends downwardly when it is in operating position.

Figure 3:
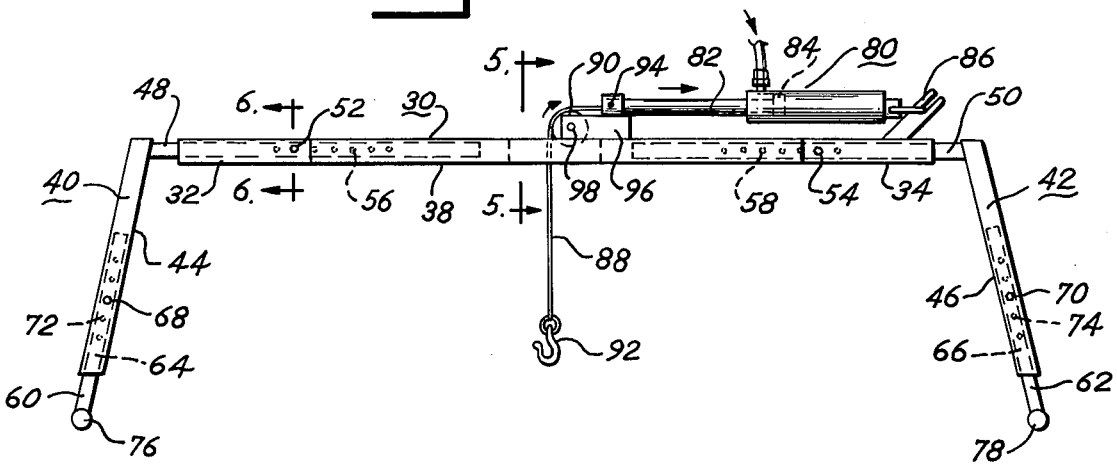
FIG. 3 is a side elevational view of the motor lift shown in FIGS. 1 and 2.
Figure 4:
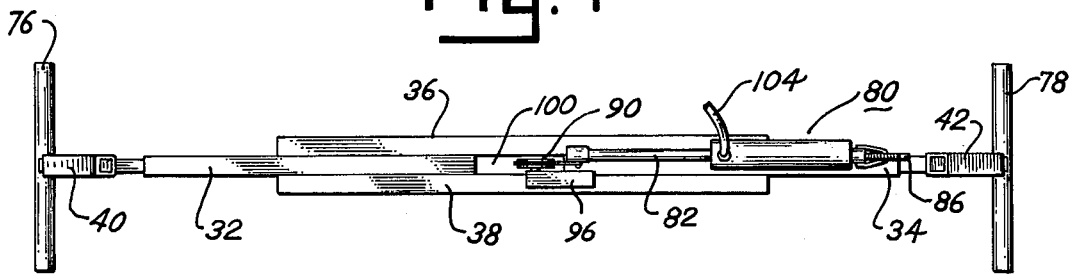
FIG. 4 is a top plan view of the motor lift shown in the preceding drawings.
Figure 5:
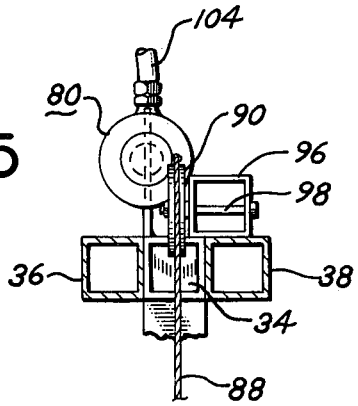
FIG. 5 is a fragmentary vertical cross sectional view of the motor lift shown in the preceding figures, the section being taken on line 5— 5 of FIG. 3.
Figure 6:
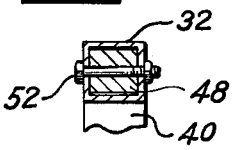
FIG. 6 is a fragmentary cross sectional view of the present motor lift, the section being taken on line 6 — 6 of FIG. 3.

The hydraulic cylinder may be operated by any suitable means, a manually operated pump being shown at numeral 102, connected to cylinder 80 by a tube 104. The hydraulic cylinder is a one-way acting type moved in the right hand direction by hydraulic fluid to retract cable 88 as handle 106 is operated to pump the fluid from cylinder 108 through tube 104. While a manual type of operating mechanism is shown, a power driven hydraulic motor may be used. A control valve 110 on the pump permits the fluid in the hydraulic cylinder to return to the pump and the piston to move to the left hand end of the cylinder as shown in FIG. 3. Further, a pneumatic motor may be used in place of the hydraulic motor.

In the operation of the vehicle supported motor lift shown in FIGS. 1 through 6, the lift is adjusted to seat firmly on the fenders or other suitable supporting structure on the vehicle, which may be frame members or other parts of the body, depending upon the type of vehicle and the location of the motor in the vehicle. The height of beam 30 above the motor is adjusted by adjusting the length of the legs, with bolts 68 and 70 being placed in the appropriate holes 72 and 74 in the legs. After the motor lift has been suitably placed over the engine, cable 88 is connected to the motor by any suitable means, such as by a chain or directly to a fixture on the motor. With the lift mounted in the foregoing manner and connected to the motor, the manually operated hydraulic pump unit 102 is operated through use of handle 106 to drive piston 84 toward the right hand end of the cylinder, as viewed in FIG. 3, thus withdrawing cable 88 and lifting attachment means 92. As the piston is forced to the right, the engine is lifted to the degree required to make the repairs to the mountings, the engine or to the frame parts adjacent the engine. Afterthe work has been completed, control valve 110 is actuated to release the fluid in the left hand end of cylinder 80, thus permitting the piston to move to the left, thereby permitting the motor to be lowered to its proper installed position. The attachment means can then be easily disconnected from the motor and the motor lift removed from the vehicle, thus completing the operation.

One of the advantages of the type of motor mechanism illustrated in the drawings is that it can be controlled by the mechanic while he is beneath the car, thus assuring proper lifting and positioning of the motor by the lift. Further, a complete repair operation can be performed without the use of an overhead hoist or any other hoist mechanism requiring supports external of the vehicle, thus economizing on space as well as providing a reliable support for the motor lift in raising the motor for the repair work.

The embodiment illustrated in FIGS. 7 through 10 is essentially the same as the embodiment previously described herein, the one of FIG. 7 having a beam 120, and legs 122 and 124, the two legs being identical to the two legs 40 and 42 of the previous embodiment, the horizontal portions 48 and 50 of the legs extending into the ends of the tubular beam 120 and bolts 126 and 128 adjusting the legs laterally to satisfy the requirements of the support. The power lift mechanism indicated generally by numeral 130 consists of a frame 132 having vertical members 134 and 136 joined at the top and bottom by members 138 and 140, the four members thus forming a rectangular structure. The two vertical members are disposed in guide sleeves 142 and 144 which are rigidly secured by welding or other suitable securing means to the sides of the beam 120. The frame 132 is movable vertically in sleeves 142 and 144 by a hydraulic cylinder 150 mounted on the upper side of beam 120 and on the under side of member 130. Thus extension of the cylinder by a hydraulic actuating device, such as hydraulic pump 102, moves the frame upwardly, thus lifting hooks 152 and 154 secured to the lower end of the frame and adapted to receive a chain placed around the motor. The cylinder is held in place within the frame by a shaft 156 secured to the lower end of the cylinder and extending downwardly through beam 120 and through a reinforcing member 158, the lower end of the shaft being secured to the reinforcing member by nuts 160 and 162 threaded onto the shaft above and below the member 158. The reinforcing member is held in spaced relationship at the center below the beam and is attached at the opposite ends of the beam. If additional strength is required of beam 120, the two nuts can be threaded downwardly on shaft 156.

In the operation of the embodiment of the modification illustrated in FIGS. 7 through 10, operation of hydraulic pump 102 forces hydraulic fluid through tube 104 at the lower end of the hydraulic cylinder beneath the piston, thus forcing the piston rod upwardly against member 138, thereby lifting frame 132 and raising the motor attached to the lower end of the frame by a chain looped through hooks 152 and 154. When the repair work on the motor has been completed, the control valve 110 is actuated, thus releasing the fluid beneath the piston in the hydraulic cylinder and permitting the frame to descend by the weight of the motor. The legs may be adjusted both laterally and vertically, as previously described herein with reference to the first embodiment, to adapt this embodiment of the vehicle supported motor lift to any standard automobile, pick-up truck or van. When the engine has been disconnected from the motor lift, the lift can be easily lifted from the vehicle and can be stored without occupying any substantial usable space in a garage or service station, and can be readily transported in a vehicle from one location to another.

While only two embodiments have been described in detail herein, various changes and modifications may be made without departing from the scope of the invention.

I claim:

1. A lift for the motor of a vehicle having lateral longitudinal side structures defining a motor compartment, comprising a generally horizontally disposed beam for mounting above the motor in a transverse position, leg means connected to each end of said beam for supporting the beam on the two lateral side structures of the motor compartment above the motor therein and including means at the bottom for seating on compartment side structures and holding said beam in an elevated position, a lift mechanism on said transversely positioned beam having a means for connecting the lift mechanism to the vehicle motor, a power operated means for raising said connecting means to lift the vehicle motor, and a means for controlling the operation of said power means.

2. A vehicle supported motor lift as defined in claim 1 in which said power operated means consists of a hydraulic cylinder, and said means for controlling the operation of said power means consists of a hydraulic pump, and a flexible line connects said pump to said hydraulic cylinder.

3. A vehicle supported motor lift as defined in claim 2 in which said hydraulic cylinder is disposed in a substantially horizontal position adjacent said beam, and said means for connecting the lift mechanism to the vehicle motor is a flexible member connected to said hydraulic cylinder and extending downwardly from said beam.

4. A vehicle supported motor lift as defined in claim 3 in which said pump is constructed to operate manually to operate said hydraulic cylinder.

5. A vehicle supported motor lift as defined in claim 4 in which at least one of said leg means is adjustable lengthwise to vary the height of said beam above the vehicle motor.

6. A vehicle supported motor lift as defined in claim 2 in which said lift mechanism includes a vertically movable frame and said power operated means consists of a hydraulic cylinder for moving said frame in the vertical direction for raising said attaching means to lift the vehicle.

7. A vehicle supported motor lift as defined in claim 6 in which at least one of said leg means is adjustable lengthwise to vary the height of said beam above the vehicle motor.

8. A vehicle supported motor lift as defined in claim 7 in which both of said leg means are adjustable axially with relation to said beam, toward and away from one another.

9. A vehicle supported motor lift as defined in claim 1 in which at least one of said leg means is adjustable lengthwise to vary the height of said beam above the vehicle motor.

10. A vehicle supported motor lift as defined in claim 9 in which both of said leg means are adjustable with relation to said beam, toward and away from one another.

11. A vehicle supported motor lift as defined in claim 1 in which at least one of said leg means is adjustable with relation to said beam, toward and away from said other leg.

12. A vehicle supported motor lift as defined in claim 1 in which said lift mechanism includes a vertically movable frame and said power operated means consists of a hydraulic cylinder for moving said frame in the vertical direction for raising said attaching means to lift the vehicle.

* * * * *